US006866261B2

(12) United States Patent
Grasmück et al.

(10) Patent No.: US 6,866,261 B2
(45) Date of Patent: Mar. 15, 2005

(54) DEVICE FOR LATERALLY ALIGNING SHEETS IN SHEET-PROCESSING MACHINES, ESPECIALLY PRINTING PRESSES

(75) Inventors: Georg Grasmück, Deidesheim (DE); Markus Leva, Darmstadt (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 20 days.

(21) Appl. No.: 10/232,174

(22) Filed: Aug. 30, 2002

(65) Prior Publication Data

US 2003/0057628 A1 Mar. 27, 2003

(30) Foreign Application Priority Data

Aug. 30, 2001 (DE) ..... 101 42 543

(51) Int. Cl.[7] ..... B65H 7/02

(52) U.S. Cl. ..... 271/228; 271/227; 271/245; 271/250; 271/252

(58) Field of Search ..... 271/226, 227, 271/228, 243, 295, 248, 250, 252

(56) References Cited

FOREIGN PATENT DOCUMENTS

| | | |
|---|---|---|
| DE | 837 703 | 5/1952 |
| DE | 971 251 | 12/1958 |
| DE | 30 11 626 A1 | 10/1981 |

*Primary Examiner*—Donald P. Walsh
*Assistant Examiner*—Kaitlin Joerger
(74) *Attorney, Agent, or Firm*—Laurence A. Greenberg; Werner H. Stemer; Ralph E. Locher

(57) ABSTRACT

A device for laterally aligning sheets in sheet-processing machines includes a pulling device having a drivable transport roller and a dabber roller mounted on a pivotable lever. A spring system cooperates with the lever for adjusting a pressing force between the rollers. The spring system has a progressive spring characteristic.

14 Claims, 6 Drawing Sheets

DEVICE FOR LATERALLY ALIGNING SHEETS IN SHEET-PROCESSING MACHINES, ESPECIALLY PRINTING PRESSES

BACKGROUND OF THE INVENTION

FIELD OF THE INVENTION

The invention relates to a device for laterally aligning sheets in sheet-processing machines, especially printing presses.

Lateral alignment of an infed sheet is usually performed by a pulling or pushing lay, which pulls or pushes the sheet against a stop. In this regard, a force is exerted on the sheet, which moves the sheet into a friction lock against the stop. The pull force or traction has to be adjusted in accordance with the speed, grammage and other settings, such as, vacuum or suction air applied to the suction belt. For printing materials with a low grammage, for example, a low pulling force is needed, and for printing materials with a high grammage, a high pulling force is needed. In addition, regions of lower grammages require a more precise setting of the pulling force than regions of high grammages.

A device of the type referred to at the introduction hereto has been disclosed in German Published, Non-Prosecuted Patent Application DE 30 11 626 A1. In that case, the pulling or pushing force is effected by two rollers which are set against one another and by which, in principle, cost-effective, exact lateral alignment of the sheet is made possible. In particular, in this regard, the sheet is pressed against a rotating roller by a freely rotatable roller, a so-called dabber roller. The required pressing force is applied by a tension or compression spring.

In the heretofore known reel-to-reel system according to the aforementioned German Published, Non-Prosecuted Patent Application DE 30 11 626 A1, the pulling force is adjusted via a spring and an adjusting screw. The spring is of the type having a linear characteristic. The adjustment is thereby equally precise over the entire range of the pulling force. If one would wish to increase the maximum possible pulling force within the existing installation space, this increase would be achieved at a cost of the adjustment accuracy.

Attempts have been made to vary the precision of the adjustment (note hereinabove), depending upon the respective requirements, by providing different compression springs, which the printer has to install in the pulling lay, depending upon the grammage. A disadvantage of such a solution for the problem is the great effort that must be made for installation or assembly purposes when the printing material has to be changed, and that material parts tend to lie around in the open in the vicinity of the feeder.

SUMMARY OF THE INVENTION

It is accordingly an object of the invention to provide a device for laterally aligning sheets in sheet-processing machines, especially printing presses, which overcomes the hereinafore-mentioned disadvantages of the heretofore-known devices of this general type and in which it is possible to adjust a pulling force in a relatively simple manner without additional installation or assembly work over the greatest possible region of printing material, so that adjustment accuracy should be high in regions that require only a comparatively low pulling force.

With the foregoing and other objects in view, there is provided, in accordance with the invention, a device for laterally aligning sheets in sheet-processing machines, comprising a pulling device having a drivable transport roller and a dabber roller mounted on a pivotable lever. A spring system cooperates with the lever for adjusting a pressing force between the rollers. The spring system has a progressive spring characteristic.

In accordance with another feature of the invention, the lever has a bearing axis and has a point at which the spring system is applied to the lever. At least one of the bearing axis and the spring application point is adjustable in location along the lever.

In accordance with a further feature of the invention, the spring system serves for applying a force to the lever in a direction defined by an angle which is adjustable.

In accordance with an added feature of the invention, the spring system has a spring characteristic composed of a plurality of linear sections of varying slope.

In accordance with an additional feature of the invention, the spring system has a continuously progressive characteristic.

In accordance with yet another feature of the invention, the spring system further comprises at least two helical compression springs disposed coaxially with respect to one another and connected in tandem.

In accordance with yet a further feature of the invention, the at least two helical compression springs are of different hardness and, together with a guide pin extending therethrough, are disposed behind one another in a blind borehole provided in a sleeve part formed as an adjusting screw. A first one of the helical compression springs has a harder spring characteristic and serves for acting directly on the lever of the pulling device. A second one of the helical compression springs has a softer spring characteristic and adjoins the first helical compression spring at a rear end thereof.

In accordance with yet an added feature of the invention, the guide pin has a collar spatially separating the first and the second helical compression springs. The sheet-aligning device further includes a ledge formed in the adjusting screw in an upper part of the blind borehole. The ledge serves as a stop in cooperation with the collar.

In accordance with yet an additional feature of the invention, a first one of the helical compression springs is directly active on the lever and has a harder characteristic than a second one of the helical compression springs. The first spring carries a pot-like sleeve at a rear end of the first spring. The pot-like sleeve is formed with a radially outwardly directed rim by which the sleeve engages over the rear end of the first spring. The second spring is received in the pot-like sleeve and is braced against a rear end of an adjusting screw which is surrounded by the first and second helical compression springs in such a manner that the first and second helical compression springs are disposed concentrically with respect to one another.

In accordance with still another feature of the invention, the spring system further comprises at least two helical compression springs disposed coaxially with respect to one another and connected in parallel.

In accordance with still a further feature of the invention, the two springs, respectively, are a first helical compression spring with a harder characteristic, and a second helical compression spring with a softer characteristic disposed concentrically within the first helical compression spring. The two springs are directly actable on the lever. The first helical compression spring is braced against a rear surface of a stop fixed to a housing, and the second helical compression spring is braced against a rear surface of an adjusting screw surrounded by both the first and the second helical compression springs.

In accordance with still an added feature of the invention, the spring system is a conical helical compression spring having a diameter which increases towards the lever.

With the objects of the invention in view, there is also provided a sheet-fed printing machine, comprising a device for laterally aligning sheets, including a pulling device having a drivable transport roller and a dabber roller mounted on a pivotable lever. A spring system cooperates with the lever for adjusting a pressing force between the rollers. The spring system has a progressive spring characteristic.

Other features which are considered as characteristic for the invention are set forth in the appended claims.

Although the invention is illustrated and described herein as embodied in a device for laterally aligning sheets in sheet-processing machines, especially printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
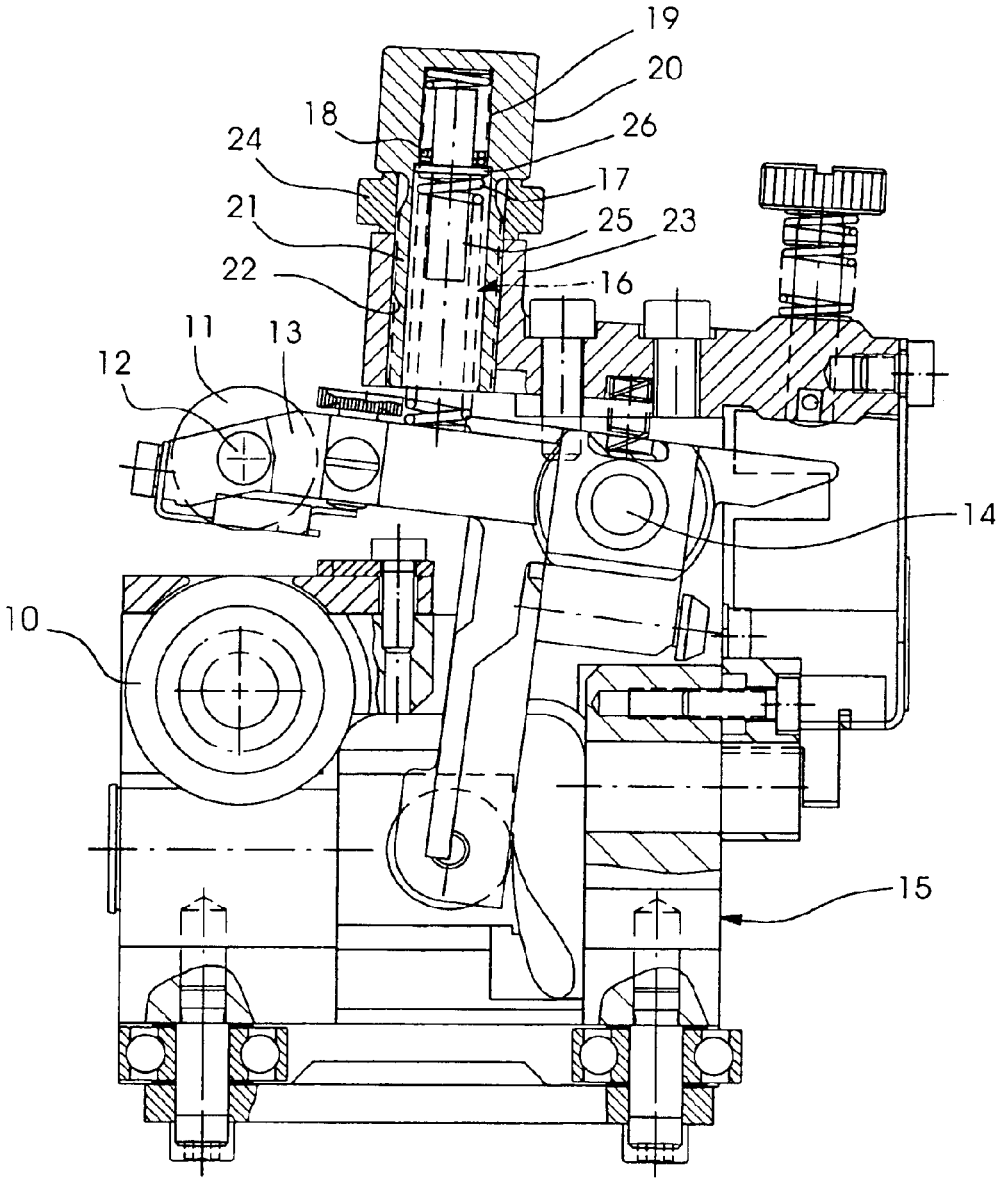
FIG. 1 is a diagrammatic, partly-sectional, side-elevational view of an embodiment of a pulling device according to the invention, with two compression springs connected in series or tandem.

Referring now to the figures of the drawings in detail and first, particularly, to FIG. 1 thereof, there is seen a pulling device according to the invention including a driven transport roller 10 for non-illustrated sheets to be printed, and a freely rotatable dabber roller 11. The dabber roller 11 is mounted at 12 on a lever 13, which is pivotably attached at 14 to a supporting frame generally identified by reference numeral 15.

The lever 13 is acted upon from above by a force applied by a spring system 16. As can also be seen in particular from the enlarged fragmentary and somewhat simplified view of FIG. 2, the spring system 16 is formed of two helical compression springs 17 and 18 which are disposed in tandem coaxially with respect to one another and are disposed in a blind borehole 19 formed in an adjusting screw 20 constructed as a sleeve part. The adjusting screw 20 has a (lower) threaded shank 21, by which it is screwed into a corresponding threaded bore 22 formed in a housing part 23. A lock nut 24 is screwed onto the upper end of the threaded shank 21. Also disposed in the blind borehole 19, surrounded by the two compression springs 17 and 18, is a guide pin 25 formed with a collar 26. Braced against the collar 26 on one side, from below, is the compression spring 17 and, on the other side, from above, is the compression spring 18. The (upper) compression spring 18 has a lower spring constant and therefore a flatter characteristic than the (lower) compression spring 17 (in this regard, note also FIG. 7 and the associated explanations provided further hereinbelow). The collar 26 on the guide pin 25 thus forms a stop which limits the spring travel of the upper (softer) compression spring 18. In this regard, the guide pin 25 is moved upwardly by the harder (lower) compression spring 17 braced against the collar 26, thereby compressing the softer (upper) compression spring 18, until it comes to rest on a ledge 27 in the blind borehole 19 (note the corresponding position in FIGS. 1 and 3). From this instant on, the spring force acting on the lever 13 and, therefore, the pulling force of the pulling device, is determined by the characteristic of the harder compression spring 17.

Figure 7:
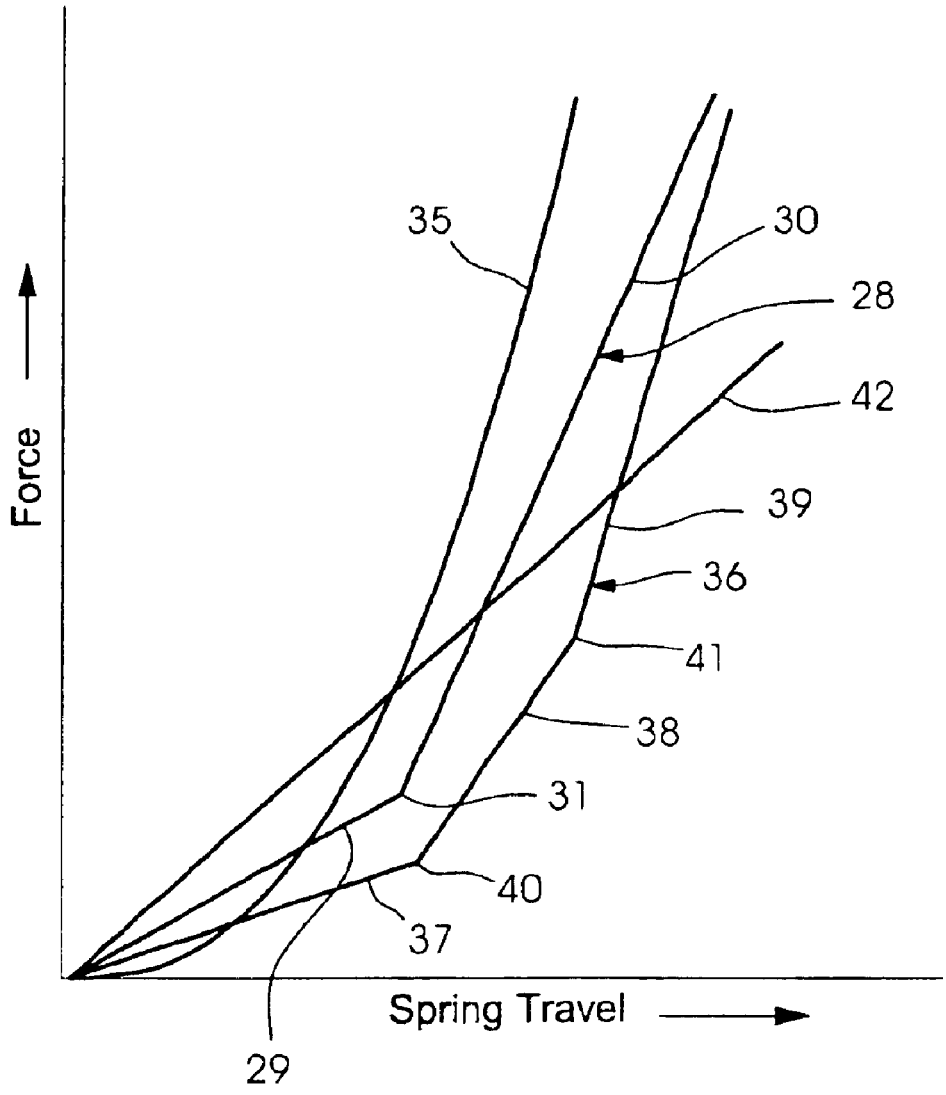
FIG. 7 is a plot diagram depicting spring force with respect to spring travel of a plurality of different characteristic curves of a spring system for a pulling device.

The overall characteristic of the spring system 17, 18 which results is illustrated in FIG. 7 by the (kinked) curve 28. In this regard, a flatly rising curve branch 29 identifies the characteristic of both compression springs 17, 18, while a more steeply rising curve branch 30 represents the characteristic of the (harder) compression spring 17. A kink or point of inflection 31 formed between the two curve branches 29 and 30 marks the instant at which the collar 26 of the guide pin 25 comes to rest against the ledge 27 of the blind borehole 19 (FIGS. 1 and 3).

With the aforedescribed in tandem-connected spring configuration, an overall characteristic is therefore realized in a simple way which permits more precise adjustment in the range of low pulling force and, at the same time, permits a high pulling force with a limited adjustment travel of the setting screw 20.

Figure 2:
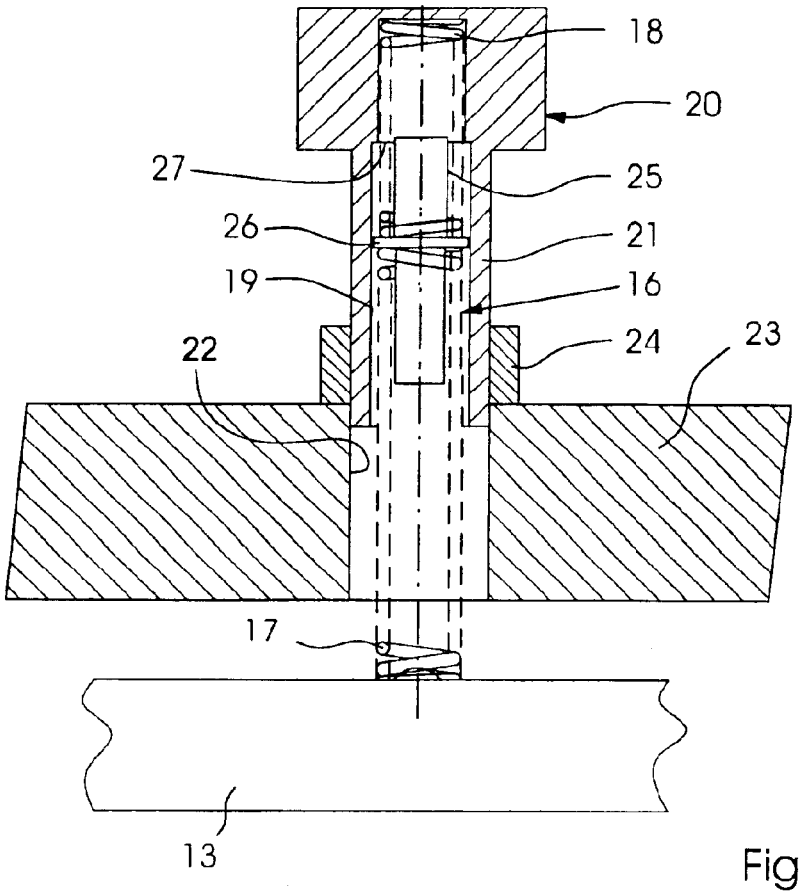
FIG. 2 is an enlarged, fragmentary, partly-sectional view of a portion of FIG. 1, showing the embodiment of the pulling device in a different operating phase thereof wherein the compression springs have only a weakly loaded setting.
Figure 3:
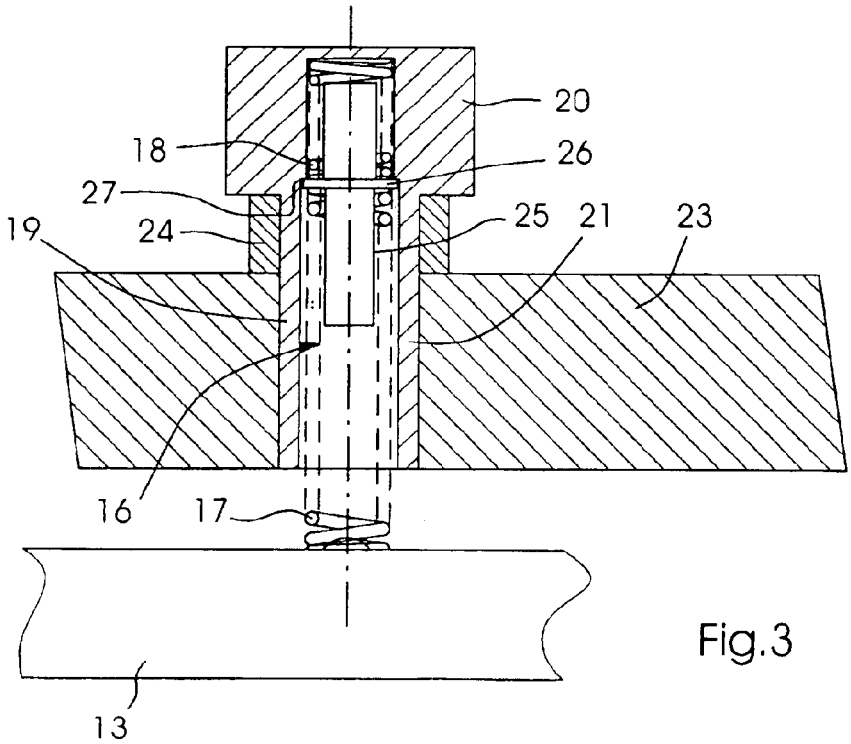
FIG. 3 is a further view similar to FIG. 2 showing the embodiment of the pulling device in yet a different operating phase thereof wherein the compression springs are in a heavily loaded end setting thereof.
Figure 4:
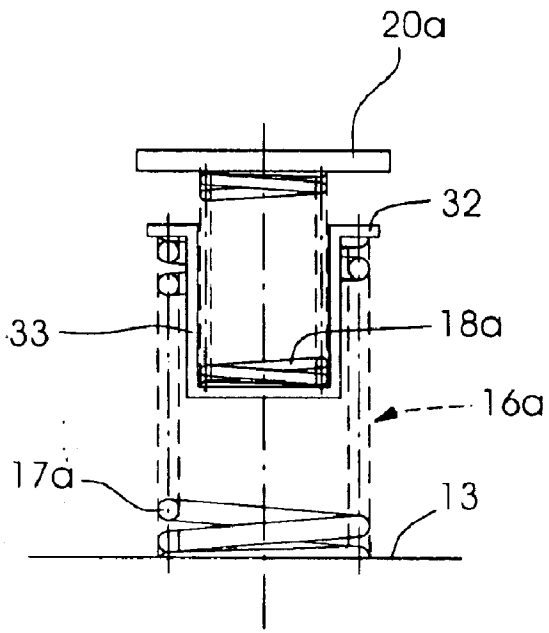
FIG. 4 is a greatly diagrammatic, longitudinal-sectional view of a different embodiment of the pulling device of FIG. 1, having compression springs connected in series or in tandem, i.e., behind one another.

A different embodiment of an in tandem-connection of two compression springs, which is modified somewhat in comparison with the spring configuration according to FIGS. 1 to 3 and by which an overall characteristic similar to the curve 28 in FIG. 7 can also be realized, is shown in FIG. 4. In a manner similar to that in the embodiment according to FIGS. 1 to 3, a harder first compression spring 17*a* acts directly on the lever 13. At the upper end of the compression spring 17*a*, however, it is supported on a rim 32 of a pot-like sleeve 33 which accommodates therein a second, softer compression spring 18*a*. At the upper end of the softer compression spring 18*a*, it is acted upon by an adjusting element 20*a*, shown diagrammatically as a plate part, which may be, for example, an adjusting screw similar to the sleeve part 20 shown in FIGS. 1 to 3. In the embodiment of FIG. 4, quite similar in result to the embodiment according to FIGS. 1 to 3, in the position of the adjusting element 20*a* shown in FIG. 4, the characteristic curve of the softer compression spring 18*a* initially comes into effect (note the curve branch 29 in FIG. 7). The significance of this setting, preferably in the case of thin sheets to be processed, is therefore that a precisely adjustable force acts on the lever (note the lever 13 in FIG. 1). On the other hand, the harder compression spring 17*a*, and only this spring, comes into use at a setting wherein the components 20*a* and 32 are in contact. At this setting, the result is a correspondingly steeper characteristic for the adjustment of the force acting on the lever 13 (compare with the curve branch 30 in FIG. 7).

Figure 5:
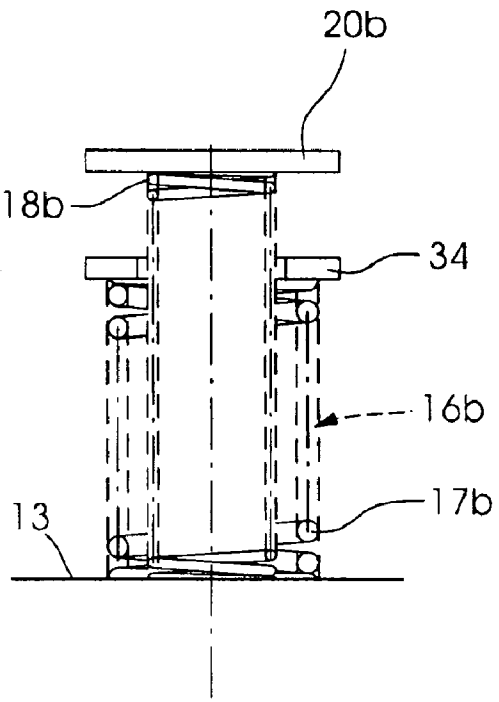
FIG. 5 is a view similar to FIG. 4, of yet a different embodiment of the pulling device in a different operating phase thereof, having yet a different construction of the springs.

FIG. 5 shows a further different embodiment wherein two compression springs 17*b* and 18*b* with different spring characteristics are connected in parallel rather than in series or tandem. The two compression springs 17*b* and 18*b* are again disposed, concentrically with respect to one another, in an adjusting element 20*b* (for example a setscrew or adjusting screw like the sleeve part 20 in FIGS. 1 to 3), but both act directly on the lever 13. In the setting shown in FIG. 5, when the adjusting element 20*b* is adjusted, the softer characteristic of the spring 18*b* initially comes into effect, which permits precise adjustment of the force acting on the lever 13 (compare with the curve branch 29 in FIG. 7). The harder compression spring 17*b* braced against a stop 34, on the other hand, does not come into effect here at all. This changes only when, upon further adjustment of the adjusting element 20*b*, the latter comes into contact with the stop 34. From this setting, the two spring characteristics add. The total characteristic of the spring system 17*b*, 18*b* is also similar here to the course of the (kinked) curve 28 in FIG. 7.

Figure 6:
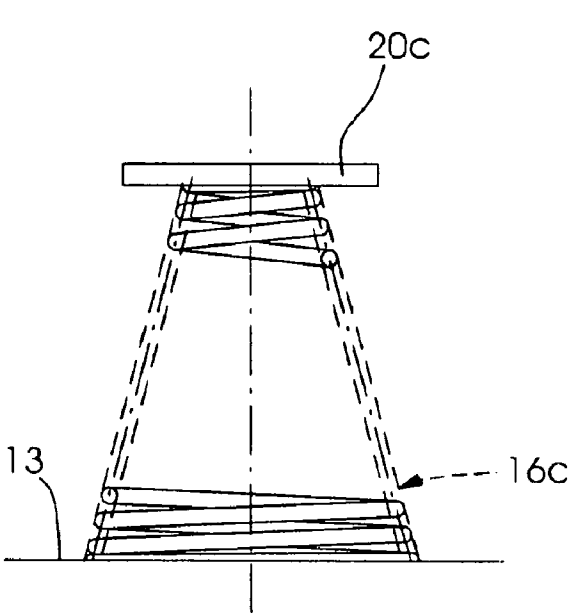
FIG. 6 is a view similar to those of FIGS. 4 and 5, of a helical compression spring for the pulling device, which is conical.

A further different embodiment according to FIG. 6 differs from the embodiments according to FIGS. 1 to 5 described hereinbefore in that only a single compression spring, namely the spring 16*c* in FIG. 6, is provided. The special feature of this compression spring 16*c* is in the conical shape thereof, the spring 16*c*, starting from the lever 13 upon which it acts, tapering continuously upwardly as far as the adjusting element 20*c*. Due to the conical shape of the compression spring 16*c*, there is produced a progressive course of the spring characteristic, which is represented in FIG. 7 by the curve 35. In addition, the embodiment according to FIG. 6 permits precise adjustment of the adjusting element 20*c* at the beginning of the adjustment travel thereof and, during further progressive adjustment, coarser adjustment of the spring force acting on the lever 13 and, therefore, of the pulling force of the pulling device.

FIG. 7 also shows a further curve 36, which overall has a highly progressive course. It is composed of three linear sections 37, 38 and 39, which form two points of inflection or kinks 40 and 41. A curve of this type may be achieved by connecting three individual springs, respectively, in series or in parallel, analogously to the spring configurations shown in FIGS. 1 to 5.

For the purpose of comparison with the spring characteristics 28, 35 and 36 having a progressive course overall, a further linear spring characteristic 42, corresponding to the prior state of the art for pulling devices, is represented in the plot diagram of FIG. 7. The aforedescribed advantages of the spring system according to the invention become particularly clear therefrom.

As is believed to be apparent from FIGS. 8 to 11, a progressive characteristic of the spring force exerted on the lever 13, at the free end of which the dabber roller 11 is mounted, can also be realized by axial displaceability of the lever support or bearing. In this regard, the displaceable bearing axis of the lever 13 is at 43, and the point of application of the spring system is at 44. An arrow 45 marks the direction of the force.

Figure 8:
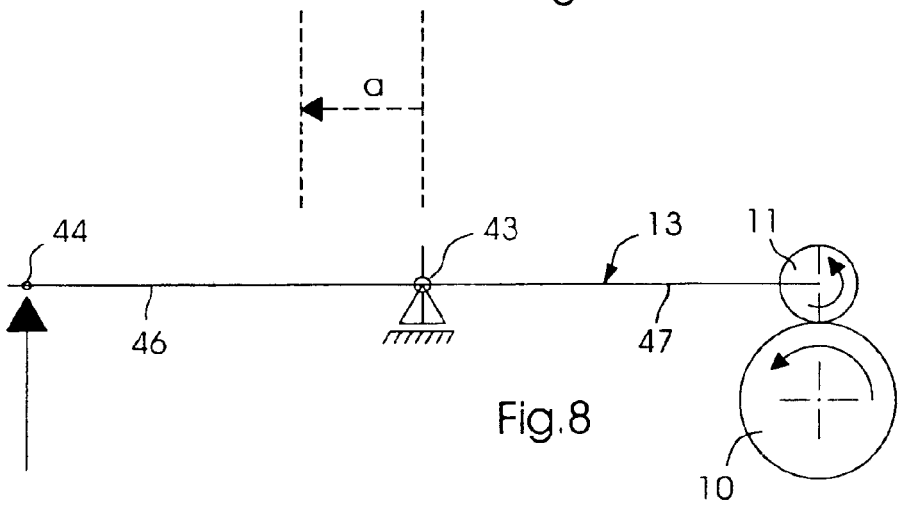
FIG. 8 is a greatly diagrammatic side-elevational view of an embodiment of a pulling device.
Figure 9:
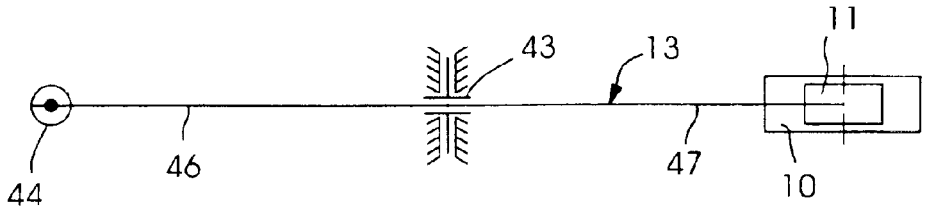
FIG. 9 is a top-plan view of FIG. 8.

In the position of the lever bearing axis 43 according to FIGS. 8 and 9, the spring system represented by the arrow 45 acts on the dabber roller 11 via a comparatively large lever arm 46 (force arm). The so-called load arm 47 located on the right-hand side of the lever bearing axis 43, as viewed in FIG. 8, has approximately the same length as the force arm 46. Accordingly, this configuration corresponds to a coarse setting of the pulling force (compare the steep curve branch 30 in FIG. 7).

Figure 10:
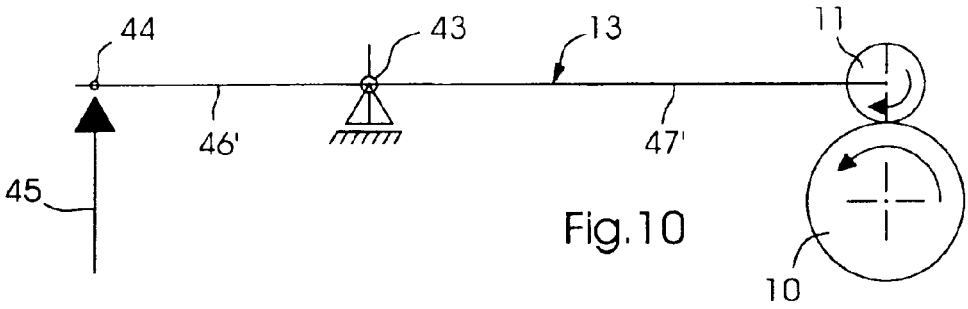
FIG. 10 is a view similar to FIG. 8, but for the bearing axis of the lever being longitudinally displaced.
Figure 11:
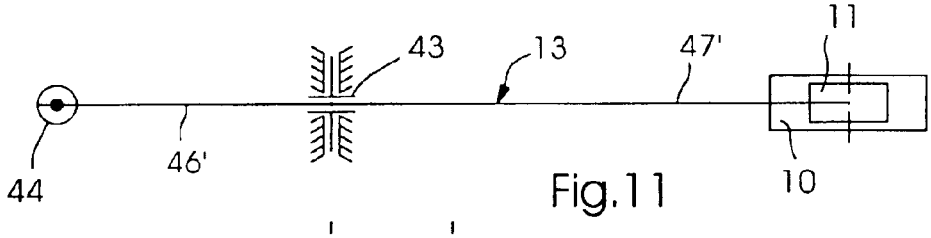
FIG. 11 is a top-plan view FIG. 10.

In the configuration according to FIGS. 10 and 11, the lever bearing axis 43 has been shifted to the lefthand side a distance a from the location thereof in FIGS. 8 and 9. As a result, the force arm, identified by the reference character 46' in FIGS. 10 and 11, is shortened accordingly, and the load arm, identified by the reference character 47' in FIGS. 10 and 11, has experienced a corresponding lengthening. In order to exert the same force on the dabber roller 11 as in the case of the setting according to FIGS. 8 and 9, a greater force or a greater spring travel is therefore required at the location 44, 45. The setting according to FIGS. 10 and 11 therefore permits precise adjustment of the pulling force on the dabber roller 11.

The measures described hereinabove and revealed by FIGS. 8 to 11 in principle do not require any spring system with a progressive overall characteristic. On the contrary, they can also be realized with a conventional spring system having a linear characteristic. There should be an advantageous effect, however, in practice, if the spring measures according to FIGS. 1 to 6 are combined with the lever measures according to FIGS. 8 to 11.

Figure 12:
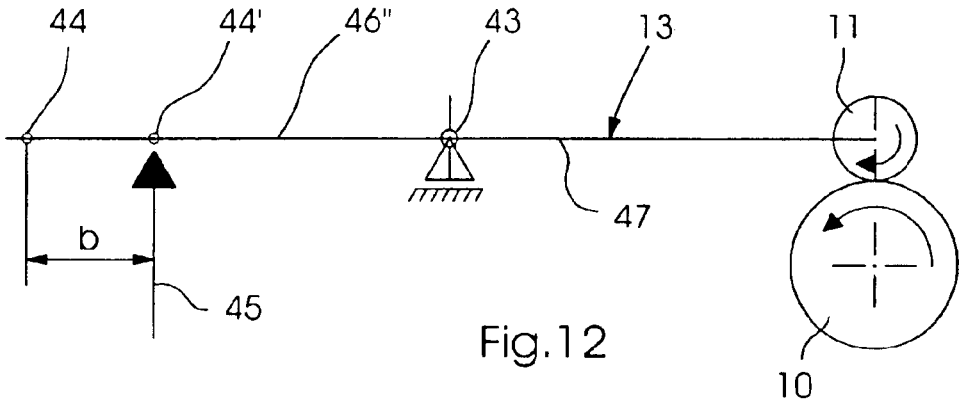
FIG. 12 is a view similar to that of FIG. 8 showing the pulling device according to FIG. 8, however, with a force application point of the spring system thereof displaced in longitudinal direction from the force application point shown in FIG. 8.

Additionally or alternatively, the measures apparent from FIGS. 12 and/or 13 can also be taken. In the alternative embodiment according to FIG. 12, wherein the lever bearing axis 43 remains at the same location as for the embodiment of FIG. 8, longitudinal adjustability of the force action point 44 of the spring system 45 is provided. Thus, the spring system 45 has been displaced to the righthand side a distance b, which results in a correspondingly shortened force arm 46" of the lever 13, with a new force application point 44'. With regard to the effects of this shortening of the force arm on the lever 13, that which is stated hereinbefore in relation to FIGS. 10 and 11 applies accordingly.

Figure 13:
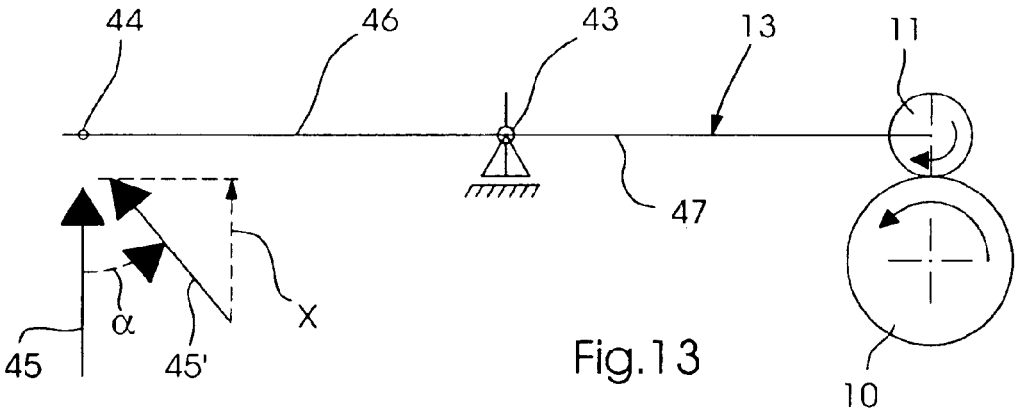
FIG. 13 is a view similar to that of FIG. 8 showing the pulling device according to FIG. 8, however, with the direction of force application of the spring system thereof being swivelled away from that of FIG. 8.

FIG. 13 shows another different embodiment of the invention, wherein, although the spring force application point 44 on the lever 13 remains the same as for the embodiment of FIG. 8, swivelling of the direction of the force 45 and 45', respectively, of the spring system is provided. If the swivelling occurs over an angle α, as is apparent from FIG. 13, the illustrated spring-force direction 45' results. Consequently, there is, indirectly, a reduction of the spring forces acting on the lever arm 46 when the spring travel is in the same direction as the direction of the force 45, because only the force component X then comes into effect at the point 44.

We claim:

1. A push/pull lay device, comprising:

a pulling device having a pivotable lever;

a drivable transport roller;

a dabber roller mounted on said pivotable lever; and a spring system cooperating with said lever and adjusting a pressing force between said rollers, said spring system having a progressive spring characteristic;

said lever having a bearing axis and a point at which said spring system is applied to said lever, and at least one of said bearing axis and said spring application point being adjustable in location along said lever.

2. The sheet-aligning device according to claim 1, wherein said spring system applies a force to said lever in a direction defined by an adjustable angle.

3. The sheet-aligning device according to claim 1, wherein said spring system has a spring characteristic composed of a plurality of linear sections of varying slope.

4. The sheet-aligning device according to claim 1, wherein said spring system has a continuously progressive characteristic.

5. The sheet-aligning device according to claim 1, wherein said spring system has at least two helical compression springs disposed coaxially with respect to one another and connected in tandem.

6. The sheet-aligning device according to claim 5, which further comprises a sleeve part formed as an adjusting screw and having a blind borehole formed therein, a guide pin extending through said at least two helical compression springs, said at least two helical compression springs having different hardness and being disposed together with said guide pin behind one another in said blind borehole, a first one of said helical compression springs having a harder spring characteristic and serving for acting directly on said lever of said pulling device, and a second one of said helical compression springs having a softer spring characteristic and adjoining said first helical compression spring at a rear end thereof.

7. The sheet-aligning device according to claim 6, which further comprises a ledge formed in said adjusting screw in an upper part of said blind borehole, said guide pin having a collar spatially separating said first and said second helical compression springs, and said ledge serving as a stop in cooperation with said collar.

8. The sheet-aligning device according to claim 5, which further comprises an adjusting screw having a rear end, said adjusting screw being surrounded by said at least two helical compression springs and maintaining said at least two helical compression springs concentric with respect to one another, a first one of said at least two helical compression springs being directly active on said lever and having a harder characteristic than a second one of said at least two helical compression springs, said first spring carrying a pot-like sleeve at a rear end of said first spring, said pot-like sleeve being formed with a radially outwardly directed rim engaging said sleeve over said rear end of said first spring, said second spring being received in said pot-like sleeve and being braced against said rear end of said adjusting screw.

9. The sheet-aligning device according to claim 1, wherein said spring system includes at least two helical compression springs disposed coaxially with respect to one another and connected in parallel.

10. The sheet-aligning device according to claim 9, which further comprises a housing, a stop fixed to said housing and having a rear surface, and an adjusting screw having a rear surface, said at least two springs being first and second helical compression springs for acting directly on said lever, said first and second helical compression springs surrounding said adjusting screw, said first helical compression spring having a harder characteristic and said second helical compression spring having a softer characteristic and being disposed concentrically within said first helical compression spring, said first helical compression spring being braced against said rear surface of said stop, and said second helical compression spring being braced against said rear surface of said adjusting screw.

11. The sheet-aligning device according to claim 1, wherein said spring system is a conical helical compression spring having an increased diameter towards said lever.

12. A sheet-fed printing machine, comprising:

a push/pull lay device including:

a pulling device having a pivotable lever;

a drivable transport roller;

a dabber roller mounted on said pivotable lever; and a spring system cooperating with said lever and adjusting a pressing force between said rollers, said spring system having a progressive spring characteristic;

said lever having a bearing axis and a point at which said spring system is applied to said lever, and at least one of said bearing axis and said spring application point being adjustable in location along said lever.

13. In a sheet-fed printing machine having a lateral sheet alignment device, a push/pull lay, comprising:

a pulling device having a pivotable lever;

a drivable transport roller;

a dabber roller mounted on said pivotable lever; and a spring system cooperating with said lever and adjusting a pressing force between said rollers, said spring system having a progressive spring characteristic;

said lever having a bearing axis and a point at which said spring system is applied to said lever, and at least one of said bearing axis and said spring application point being adjustable in location along said lever.

14. A push/pull lay device, comprising:

a pulling device having a pivotable lever;

a drivable transport roller;

a dabber roller mounted on said pivotable lever; and a spring system cooperating with said lever and adjusting a pressing force between said rollers, said spring system having a progressive spring characteristic;

said spring system having at least two helical compression springs disposed coaxially with respect to one another and connected in tandem.

* * * * *